US005751817A

United States Patent [19]

Brungart

[11] Patent Number: 5,751,817

[45] Date of Patent: May 12, 1998

[54] SIMPLIFIED ANALOG VIRTUAL EXTERNALIZATION FOR STEREOPHONIC AUDIO

[76] Inventor: Douglas S. Brungart, 23 Hampshire St, Apt 5, Salem, N.H. 03079

[21] Appl. No.: 775,230

[22] Filed: Dec. 30, 1996

[51] Int. Cl.[6] ..... H04R 5/02

[52] U.S. Cl. ..... 381/25

[58] Field of Search ..... 381/17, 25, 26, 381/74

[56] References Cited

U.S. PATENT DOCUMENTS

| | | | |
|---|---|---|---|
| 3,920,904 | 11/1975 | Blavert et al. | 381/25 |
| 4,136,260 | 1/1979 | Asahi | 179/1 |
| 4,209,665 | 6/1980 | Iwahara | 381/25 |
| 4,672,569 | 6/1987 | Genuit | 364/801 |
| 4,686,374 | 8/1987 | Liptay-Wagner et al. | 250/571 |
| 5,031,216 | 7/1991 | Gorike et al. | 381/26 |
| 5,181,248 | 1/1993 | Inanaga et al. | 381/25 |
| 5,511,129 | 4/1996 | Craven | 381/103 |

OTHER PUBLICATIONS

J.M. Loomis, C. Hebert, and J.G. Cicinelli, "*Active Localization of Virtual Sounds*", J. of Acoustic Society of America, vol. 88 (4), Oct. 1990, pp. 1757–1764.

F.L. Wightman, D.J. Kistler, "*The Dominant Role of Low–Frequency Interaural Time Differences in Sound Localization*," J. of the Acoustic Society of America, vol. 91, 1990, pp. 1648–1660.

*Primary Examiner*—Forester W. Isen

*Attorney, Agent, or Firm*—Gerald B. Hollins; Thomas L. Kundert

[57] ABSTRACT

A simplified, low-cost analog system for displacing the perceived source of a stereophonic studio signal from an inherent location within the listener's head to selected fixed alternate locations such as thirty degrees on either side of and a few feet in front of the listener. The disclosed system employs selected analog filters including ear canal resonance-simulating pinna related filters and signal delaying multiple poled Bessel filters to displace the apparent sound source to the predetermined external locations. The audio filter elements are preferably implemented with operational amplifiers with the pinna related filter enhancing frequencies around 5 KHz, and with the output of the pinna related filter being sent directly to one audio channel, and the output of the delay filter is sent to the other channel. Two signal channels can be processed simultaneously using a symmetrical circuit for the other input channel and mixing together the outputs. Both use of pinna related filtering in each channel of the system and dual benefit use of a Bessel function based delay are believed notable aspects of the invention.

17 Claims, 4 Drawing Sheets

SIMPLIFIED ANALOG VIRTUAL EXTERNALIZATION FOR STEREOPHONIC AUDIO

RIGHTS OF THE GOVERNMENT

The invention described herein may be manufactured and used by or for the Government of the United States for all governmental purposes without the payment of any royalty.

BACKGROUND OF THE INVENTION

This invention relates to the field of headphone stereophonic audio signal reproduction which includes a simplified and cost-effective arrangement for virtual disposition of the audio signal sources external to the listener.

A need for enhanced cockpit display systems in aircraft and improved intelligibility in large aircraft intercommunication systems used by multiple talkers are two of several situations arising in military equipment in which generation of reasonably well externalized or virtually displaced sound sources in an audio system offers human communication advantages. Previous virtual audio systems have used bulky and expensive digital signal processing systems to provide such externalized sound sources in a flexible and laboratory useful manner. For several reasons which include dollar, size and weight costs, and equipment reliability considerations, it is desirable to also provide externalized sound sourcing in the most simple and field-adapted form possible. The present invention addresses this need by accomplishing externalized sound sourcing using analog signal processing accomplished with readily available operational amplifiers and passive components.

The U.S. patent art indicates the presence of inventive activity relating to the field of externalized sound sourcing. The invention of N. Asahi in U.S. Pat. No. 4,136,260 is, for example, of general interest with respect to such systems in the sense that it discloses a headphone externalization system employing a notch or dip filter in one of the two signal paths applied to each ear—in order to simulate one aspect of ear frequency characteristics. The Asahi apparatus also discloses use of signal delay elements, a mutual addition of opposite channel crosstalk signals and dedicated circuit treatment of interaural difference, reflected sound, and reverberation components of externalized sound signals. The present invention is; believed distinguished over that of the Asahi disclosure by the expressly recited analog delay apparatus, by the interaural signal delaying and filtering algorithm used, by the consideraticn of ear canal resonance, by the combination of two needed functions into a single component element and by the employment of externalization circuitry in the signal path to each ear of the user.

Patents of background interest with respect to the present invention also include the U.S. Pat. No. 5,031,216 of R. Gorike et al. which is concerned with a stereophonic system and use of a combination filter and a dummy head in signal transducing operations. The '216 patent discloses use of a Bessel function as a characterization of an ear externalization frequency rolloff but does not espouse use of a Bessel filter-accomplished signal delay. Even though this Bessel function and a Bessel filter bear similar names, the Bessel function relates, to a mathematical tool useful in solving differential equations, i.e., to a mathematical function resembling a damped sinusoid in waveform, while the Bessel filter is a type of electrical wave filter having maximally flat group delay in its passband. Except for their name similarity, the two concepts are essentially unrelated and the '216 patent therefore appears of small interest with respect to the present invention.

Patents of background interest with respect to the present invention also include the U.S. Pat. No. 5,511,129, of P. G. Craven et al. which is concerned with a programmable audio frequency system that is also subject to conditioning, a system which includes a Bessel filter element having a maximally flat approximation to a unit delay. The Craven et al. patent appears, however, not to recognize the suitability of such a Bessel filter for use in a crosstalk circuit where both its frequency selective and its flat delay characteristics are desirable, as is accomplished in the present invention.

Patents of background interest with respect to the present invention also include the U.S. Pat. No. 4,686,374 of N. Liptay-Wagner which is concerned with a video reflectivity inspection system incorporating a Bessel filter element having a constant delay time characteristic. The video/optical nature of the Liptay-Wagner apparatus, as opposed to the audio/hearing and stereophonic nature of the present invention, are believed to provide a significant area of distinction for the present invention.

Patents of background interest with respect to the present invention further include the U.S. Pat. No. 4,672,569 of K. Genuit, which discloses the use of a complex directionadjustable microprocessor circuit, a circuit which seeks to duplicate the ear transfer function in discrete pieces with the use of analog filters. Although some aspects of the Genuit patent bear resemblance to aspects of the present invention, the objectives sought are readily distinguished from applicant's invention.

In addition to these patents, several publications are also of interest with respect to the present invention. For example, Loomis et al. (herein, Loomis) developed an analog-based audio localization system in 1990 for research purposes. This system uses a crude approximation of the HRTF. The Loomis input signal is filtered into two bands, using a crossover frequency of 1800 Hz. The amplitude of the low frequency band is fixed for both ears, and the amplitude of the high frequency band for each ear is adjusted according to desired source location. This adjustment reflects both head shadowing (varying sinusoidally with azimuth, and with a maximum interaural difference of 16 dB for a signal sound directly left or right of the head) and pinnae effects (varying sinusoidally with one-half of the azimuth, using attenuations of 3 dB directly behind the listener and 0 dB directly in front of the listener). The Loomis interaural time delay is implemented with an analog delay line. Although the Loomis system is apparently less expensive than a digital based system, it requires an analog delay line and probably a personal computer for system control. Furthermore, it provides only a crude approximation of the actual HRTF, and is capable of processing only one input signal. The Loomis work is reported in the article by Loomis, J. M., Hebert, C., and Cicinelli, J. G. (October, 1990), the article *Active Localization of Virtual Sounds*, appearing in the Journal of The Acoustic Society of America, volume 88 pages 1757–1764. The present invention is distinguished from the Loomis et al., apparatus by its absence of a delay line and other differences.

SUMMARY OF THE INVENTION

The present invention provides for the minimalized accomplishment of virtual signal externalization in headphone-reproduced stereophonic audio signals using analog processing, ordinary components and combined frequency rolloff and signal delay element-inclusive realization.

It is an object of the present invention, therefore, to provide a simple and low cost stereophonic headphone externalization apparatus.

It is another object of the invention to provide a stereophonic headphone externalization apparatus in which the usually appearing single source of sound located in the listener's head is replaced by two virtual sound sources located in a symmetric pattern disposed external to the listener.

It is another object of the invention to provide a stereophonic headphone externalization apparatus in which needed delay and bandpass frequency rolloff functions are simultaneously achieved.

It is another object of the invention to provide a stereophonic headphone externalizatior) apparatus in which these needed delay and bandpass frequency rolloff functions are simultaneously achieved using an unusual and frequency-independent signal processing algorithm.

It is another object of the invention to provide a stereophonic headphone externalizatien apparatus in which these needed delay and bandpass frequency rolloff functions are simultaneously achieved using an unusual Bessel filter signal processing algorithm.

It is another object of the invention to provide a stereophonic headphone externalization apparatus in which these needed delay and bandpass frequency rolloff functions are simultaneously achieved using a Bessel filter signal processing algorithm which includes four poles and a zero in its S plane characterization.

It is another object of the invention to provide a stereophonic headphone externalization apparatus in which a signal filtering and summing algorithm is used to simulate human outer ear effects on the stereophonic signals.

It is another object of the invention to provide a stereophonic headphone externalization apparatus in which a summation of signals appearing in left and right input channels, one delayed, one not, is used to simulate interaural delay effects.

It is another object of the invention to provide a stereophonic headphone externalization apparatus in which an interaural delay function is used in each stereophonic channel of the apparatus.

It is another object of the invention to provide a low-cost small sized stereophonic headphone externalization apparatus which may be used in a variety of different equipment types including military, industrial and especially consumer-oriented systems.

Additional objects and features of the invention will be understood from the following description and claims and the accompanying drawings.

These and other objects of the invention are achieved by an externalized stereophonic audio virtual signal source apparatus comprising the combination of:

a first audio frequency signal-processing channel having a first analog ear frequency response-simulating pinna related filter element coupled to a first stereophonic signal input node of said apparatus and a first analog Bessel filter signal delay element coupled to an output node of said first ear frequency response simulating analog pinna related filter element;

a second audio frequency signal-processing channel having a second analog ear frequency response-simulating pinna related filter element coupled to a second stereophonic signal input node of said apparatus and a second analog Bessel filter signal delay element coupled to an output node of said second ear frequency response simulating analog pinna related filter element;

said first audio frequency signal-processing channel further including a first signal summing output signal generator element having one input connected also with an output node of said first analog pinna related ear frequency response simulating filter element, another input connected with an output node of said second analog Bessel filter delay element and having an output signal path connected to a first output node of said audio frequency signal-processing channel; and said second audio frequency signal-processing channel further including a second signal summing output signal generator element having one input connected also with an output node of said second analog pinna related ear frequency response simulating filter element, another input connected with an output node of said first analog Bessel filter delay element and having an output signal path connected to a second output node of said audio frequency signal-processing channel.

DETAILED DESCRIPTION

Figure 1A:
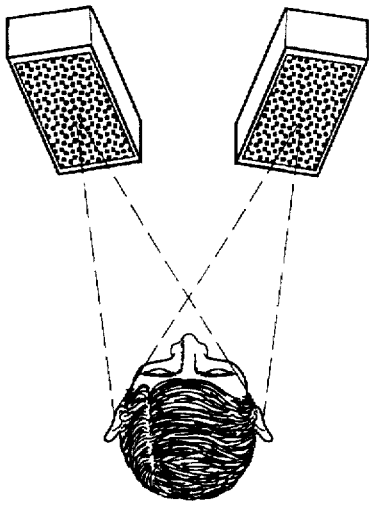
FIG 1*a* is a first part of FIG. 1 and shows a first portion of a comparison between loudspeaker and headphone reproductions of stereophonic sound.
Figure 1B:
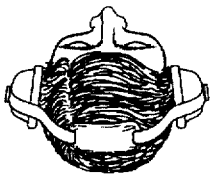
FIG 1*b* is a second part of FIG. 1 and shows a second portion of a comparison between loudspeaker and headphone reproductions of stereophonic sound.
Figure 1C:
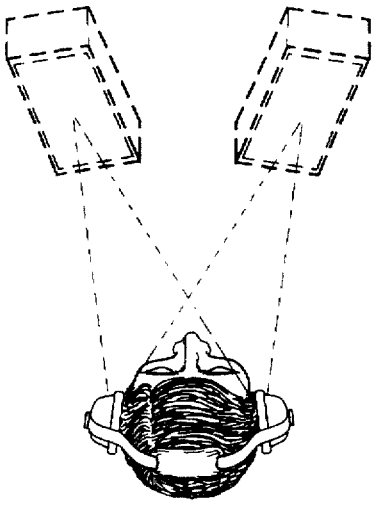
FIG 1*c* is a third part of FIG. 1 and shows a third portion of a comparison between loudspeaker and headphone reproductions of stereophonic sound.

There are fundamental differences between listening to stereophonic signals through loudspeakers and listening to stereophonic signals through headphones. FIG. 1 in the drawings (which includes the three separate views of FIG. 1*a*, FIG. 1*b* and FIG. 1*c*) illustrates these differences in pictorial form. FIG. 1 compares reproduction through stereophonic loudspeakers, FIG. 1*a*, to reproduction through standard headphones, FIG. 1*b*, and through virtual stereophonic headphones, FIG. 1*c*. Note the longer path length and head shadowing effect for the signal traveling to the farther ear of the listener in the FIG. 1*a* loudspeaker instance. This effect in fact causes a delay in addition to spectral filtering for the signal reaching the far ear from each stereophonic channel and this combination of effects is interpreted by a human listener as an identification of a sound source location.

In the FIG. 1*b* standard headphone case, however, an opposite ear signal is completely absent at each ear of the listener, and the effects of the outer ear are also missing. The virtual audio headphone system of FIG. 1*c* electronically reproduces the outer ear effects in the signal reaching the listener's far ear for each channel, creating a more natural stereophonic image, an image approximating that which would be provided by the loudspeakers shown in dotted form. In the FIG. 1*a*, loudspeaker instance interaction also occurs between sound waves approaching the head and the outer ear of the listener. This causes a spectral filtering of the signal before it reaches the eardrum. When headphones are used, however, the outer ear has no effect on sound reaching the eardrum, so this spectral filtering does not occur. This phenomenon contributes to the usual stereophonic headphone perception that the sound is originating from "inside the head" of a listener.

A second difference in the FIG. 1*a* loudspeaker instance occurs because of the binaural effects of a sound source outside the head of the listener. Sound that approaches the head from an external source will reach both the left and right ears. If the sound is not in the median plane, it will be closer to one ear than to the other ear. Consequently, it reaches the closer ear first, then reaches the farther ear after a short propagation delay. Furthermore, the sound reaching the farther ear has a different spectral shape due to the shadowing effect of the head. When headphones are used, the left and right channels are again completely isolated and this binaural information is lost.

Figure 2:
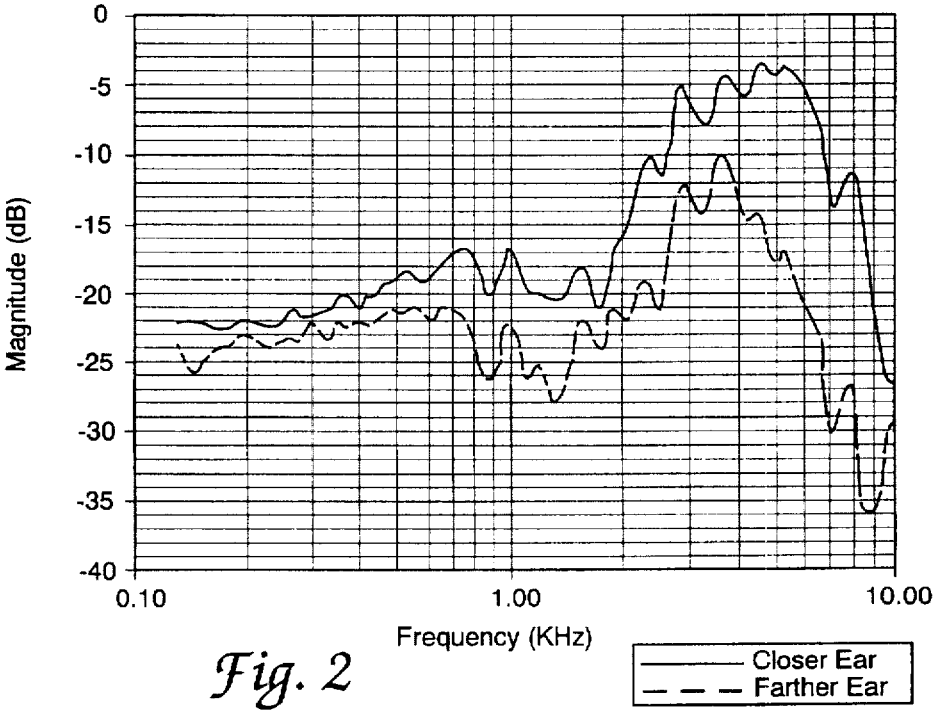
FIG. 2 shows a head-related transfer function for one position of a sound source.

These two effects are measured by the Head Related Transfer Function (HRTF), which is a magnitude and phase related transfer function characterizing transmission from a distant sound source to the eardrum of a listener. An HRTF used to develop the present invention was collected with microphones placed in the ears of a KEMAR (i.e., a Knowles Electronic Mannequin for Acoustic Research) acoustic mannequin. For these present invention purposes the sound source was placed seven feet from the mannequin at ear level, 30 degrees left of center. FIG. 2 in the drawings shows the magnitude spectrum of the transfer function for the closer and farther ears under these conditions. (Although movement of two "inside the head" sources to locations outside the head is desired in the present invention, symmetric sources and consideration of one source at a time is implied in this language.)

The phase difference between the near and far ears for such a source at 30 degrees azimuth in the horizontal plane is a constant group delay of approximately 250 microseconds duration. The present invention stereophonic externalization system is disposed, in its disclosed preferred embodiment form, to reproduce the head related transfer function and interaural time delay of two such sound sources, one thirty degrees left of the listener and one thirty degrees right of the listener, using the simplest and least expensive apparatus possible.

A system of this nature has numerous potential uses. Channel separation of this degree can be used, for example, to process two competing and listener confusing speech signals, and represent one channel as a source located in front and to the left of the listener, and the other channel as a source located in front and to the right of the listener. An arrangement of this type is believed capable of enhancing the ability of a listener to concentrate attention on one of the competing speech signals. Such an ability has been considered helpful in a two-channel intercommunication system (as used in a multiple person aircraft, for example), particularly in a noisy environment.

In consumer electronics, a system of this nature could be implemented in several possible forms; in a stand-alone version which plugs directly into the headphone jack of a stereophonic sound source and provides an output headphone jack; i.e., as virtual stereophonic processing added to existing stereophonic equipment having a headphone output port. Another possible consumer electronics form of the system may incorporate the externalization processing of the invention as a subsystem of a portable compact disc player, tape player, digital audio tape player, or other personal stereophonic system. It is believed relevant that consumer-oriented externalization systems have been absent from the popular marketplace largely because of the unavailability of a simple inexpensive and yet effective apparatus for achieving this function heretofore.

From an academic or technical viewpoint rather than a practical viewpoint, however, several methods have actually been available to add the Head Related Transfer Functions and Interaural Time Delays (ITD's) of a real sound source to a stereophonic audio signal presented by way of headphones. In general, these methods can be divided into the two broad classes of binaural recording and digital signal processing. One system using analog signal processing (i.e., the Loomis et al. system) has also been discussed in the literature as is disclosed above; this system is also additionally discussed below herein.

Binaural recordings are perhaps the simplest way of introducing HRTFs and ITDs into a stereophonic audio signal. Such recordings are made from microphones also disposed in the left and right ear canals of an acoustic mannequin. The binaural information in the mannequin's environment is accurately captured on the left and right channels of the recording. Under such conditions the recordings are capable of generating a realistic externalized stereophonic image. This method is simple and effective, and the resulting recordings can be played on any stereophonic tape player. Unfortunately, such binaural recording cannot be used with stereophonic loudspeakers, and processing to adapt signals from such recordings to loudspeaker use cannot be accomplished in real time. For this reason, the binaural recordings approach is applicable only to audio signals recorded exclusively for playback through headphones at a later time.

Signal processing, usually accomplished in digital form, can also be used to make an audio signal appear to originate from any desired location relative to a listener. In such processing the head related transfer functions and interaural time delays are first measured with an acoustic mannequin. These measurements are often made for a large number of source locations and the results are stored for easy retrieval by a digital signal processing system. When a sound source disposed in a certain location is required, the appropriate HRTF and ITD are selected and used to process an audio signal from this stored data. Two digital filters, one for each ear, implement the HRTF, and a digital delay in one channel generates the ITD.

Some of these systems, including the "Convovotron" of Crystal River Engineering Company, the "Auditory Localization Cue Synthesizer" of the herein named inventor's United States Air Force Armstrong Laboratory, and the "PDP-1" of the Tucker Davis Technology Company, also use an electromagnetic head tracker to update the source position relative to the listener's head, an update performed in real time. These systems are effective, capable of processing signals in real time, and often able to generate simultaneous sources disposed at more than one location. Their primary drawback is equipment size, complexity and expense. These systems require use of extensive signal processing to implement the digital filtering, as well as use of dedicated memory and both analog-to-digital and digital-to-analog converters. The expense, bulk, and power requirements necessary for implementing such digital audio localization systems often prohibit their use in the high-volume, low-cost applications addressed by the present invention.

In addition to such digital systems, a team publishing in 1990 under the name of Loomis et al. developed, as indicated above herein, an analog-based audio localization system for research purposes. This system uses a crude approximation of the HRTF. The Loomis input signal is filtered into two bands, using a crossover frequency of 1800 Hz. The amplitude of the low frequency band is fixed for both ears, and the amplitude of the high frequency band for each ear is adjusted according to desired source location. This adjustment reflects both head shadowing (varying sinusoidally with azimuth and also with a maximum interaural difference of 16 dB for a signal sound directly left or right of the head) and pinnae effects (varying sinusoidally with one-half of the azimuth, using attenuations of 3 dB directly behind the listener and 0 dB directly in front of the listener.) The Loomis ITD is implemented with an analog delay line. Although the Loomis system is apparently less expensive than a digital based system, it requires an analog delay line and probably a personal computer to control the system. Furthermore, it provides only a crude approximation of the actual HRTF, and is capable of processing only one input signal.

These identified digital based systems and the Loomis analog based system are all arranged to allow user manipulation of the audio signal location in real time. This creates a flexible and laboratory usable system with a wider range of applications than a system with a fixed source location; it also adds significant system complexity and expense. No systems generating the best possible binaural cues for audio sources in fixed locations at a minimum cost are known.

The externalization system of the present invention therefore approximates the head-related transfer functions and interaural time delays of a pair of sound sources located 30 degrees to the left and right of a listener. The disclosed arrangement of the system, shown schematically at 700 in FIG. 7 of the drawings herein, includes a standard male miniplug input connector and two stereophonic miniplug output jacks, and employs two 9-volt batteries as power supply. This arrangement is divided into three stages for each of the stereophonic channels 708 and 710; a pinna related filter 702, an interaural delay filter 704, and an output summing stage 706. The following topics of this specification referring to the schematic diagram of FIG. 7, describe each stage in detail, and compare the actual measured output of the system to transfer functions measured by the KEMAR mannequin.

Pinna Related Filter

The pinna related filter employed in the present invention apparatus emulates the monaural head-related transfer function from a distant source to the user's nearer ear. The accomplished approximation is achieved by adding the input signal of each channel as modified by a five kilohertz bandpass filter to the unmodified input signal itself using selected addition proportions This combination results in a pinna related filter frequency response which is enhanced in the vicinity of the center frequency of the bandpass filter, but is constant across the remainder of the frequency spectrum. The pinna related filters for each of the stereophonic channels 708 and 710 appear in the stage 702 in FIG. 7.

Figure 7:
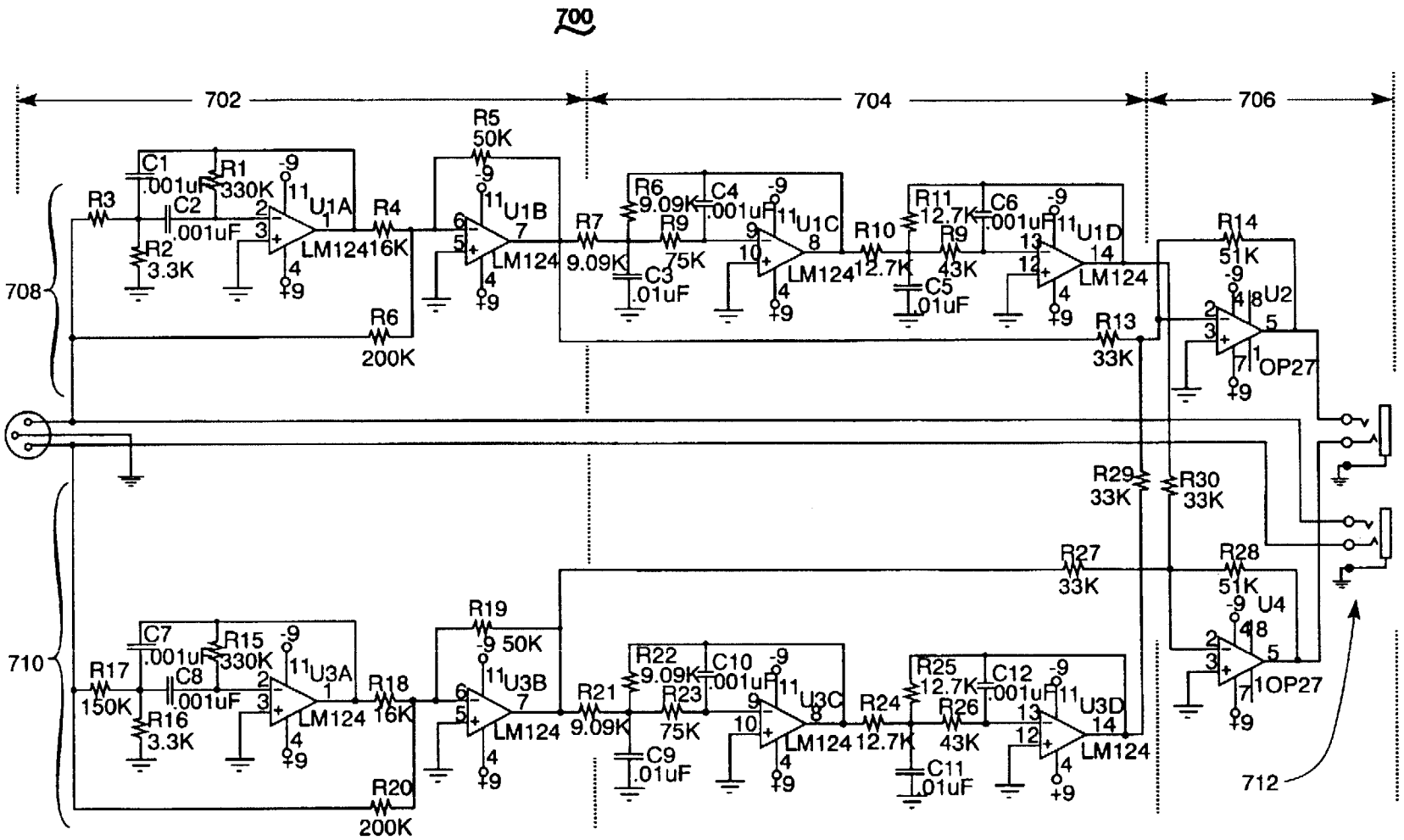
FIG. 7 shows an electrical schematic of a preferred embodiment of the invention.

Each of the pinna related filters at 702 in FIG. 7 include an infinite gain, multiple feedback path, single operational amplifier bandpass filter, embodied with the operational amplifiers U1A and U3A, each of these amplifiers includes two reactive elements or two capacitor elements in its signal processing circuitry. The indicated components for this filter provide a specified center frequency of 5 kilohertz, a quality factor (Q), of 5, and an inverting maximum gain, $H_o$ of −1. The second part of each pinna related filter at 702 is an inverting summing/scaling circuit using the operational amplifiers U1B and U3B. This part of the pinna related filters 702 adds the output of each bandpass filter, with a gain of 10 dB, to the 12 dB attenuated input signal.

Figure 3:
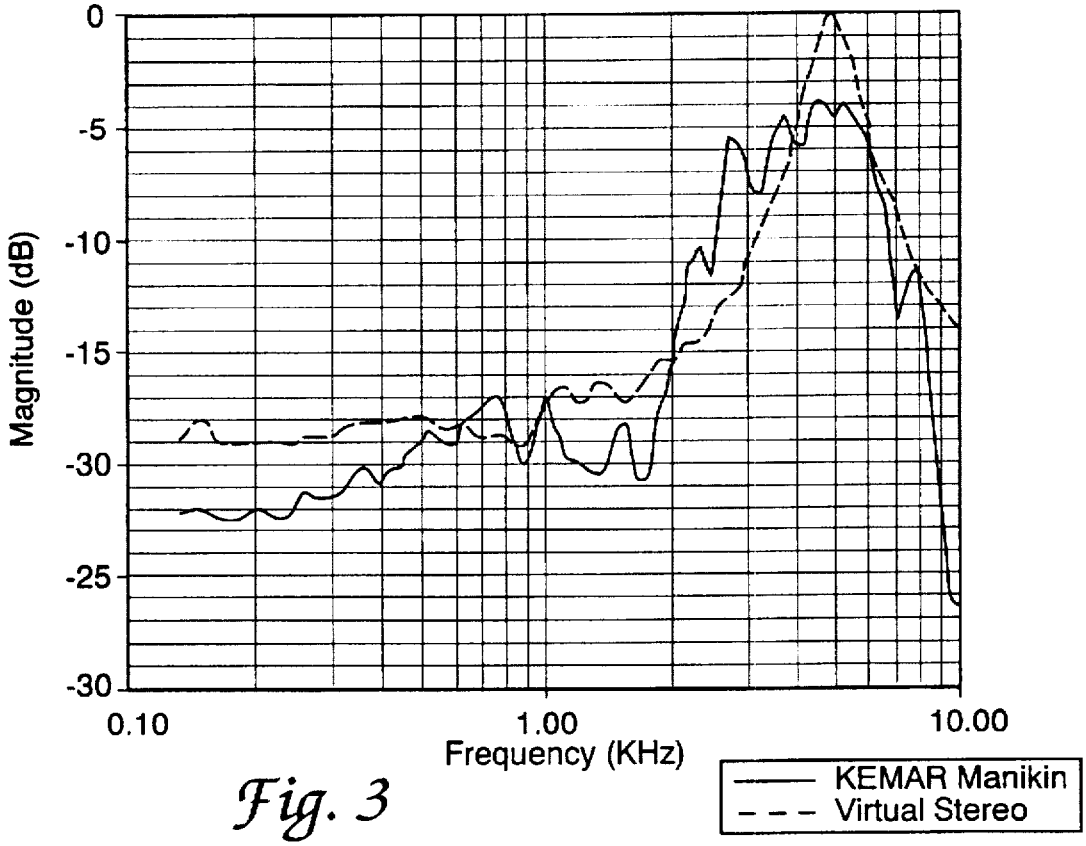
FIG. 3 shows a comparison of a mannequin head related transfer function and a virtual stereophonic reproduction of sound.

The frequency response of each channel in the pinna related filters 702 is compared to the HRTF measured from the KEMAR mannequin at 30 degrees in FIG. 3 of the drawings. The achieved approximation is considered to be unusually accurate, considering the simplicity of the filter used. The phase spectrum of the filter is not shown in FIG. 3, since it is unimportant in this application. Because the left and right channels are passed through identical filters, any phase distortion caused by the pinna related filters 702 will be duplicated for both channels and will not be perceptible to a user's ear. Only phase differences between the left and right channels are in fact significant in this application, and this phase difference is addressed by the following delay filter stage at 704.

Interaural Delay Filter

The second FIG. 7 stage for each channel 708 and 710, the delay filter stage at 704 therefore implements a fourth order Bessel filter. A Bessel filter, although perhaps unusual for this purpose, is selected because it provides the two basic properties needed for the interaural transfer function, i.e., a constant group delay for low frequencies and a low-pass frequency response. The group delay of the Bessel filter relates directly to the inverse of the nominal cutoff frequency of the filter. The needed interaural time delay for 30 degrees of source displacement is approximately 250 microseconds. A nominal cutoff frequency of 4000 radians/second (636 Hz) may therefore be used. The fourth order form of the Bessel filter is selected because it provides a reasonably flat group delay up to four times the nominal cutoff frequency, or up to about 2400 Hz.

A study by Wightman and Kistler [F. L. Wightman, D. J. Kistler, *The Dominant Role of Low-Frequency Interaural Time Differences in Sound Localization*, Journal of the Acoustic Society of America, volume 91, pages 1648–1660, (1990)] has shown that time delay below 2500 Hertz dominates in the perceived location of a sound source containing low frequencies. In view of this finding, a constant group delay up to 2400 Hz is considered to be necessary and also sufficient for the interaural delay of the present application. This Wightman and Kistler finding in fact provides substantial overall theoretical support for the present invention.

Figure 4:
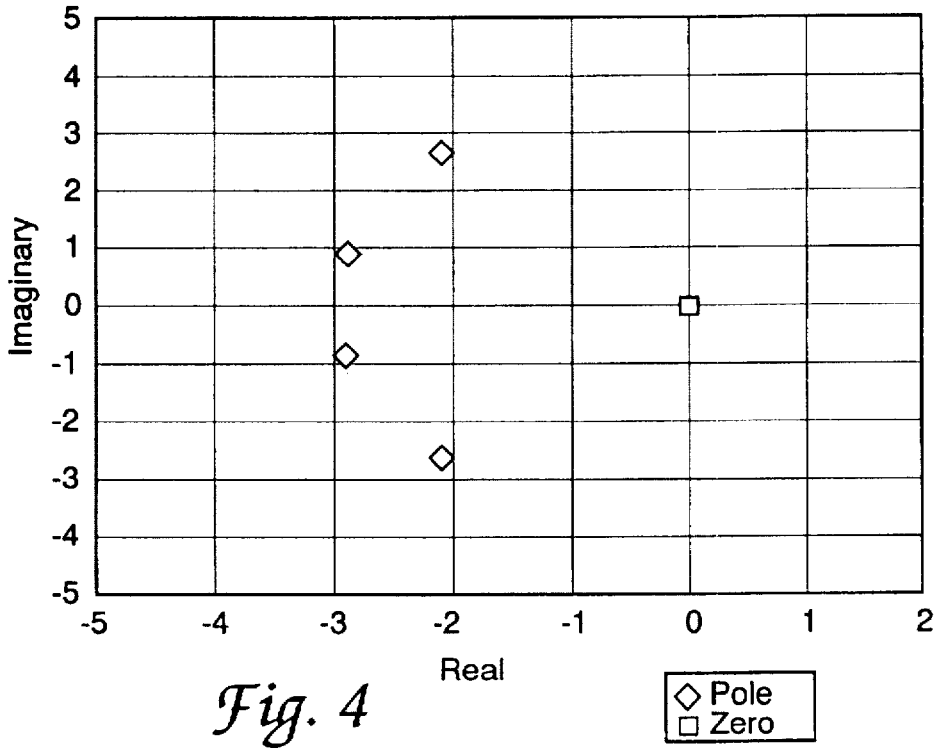
FIG. 4 shows a pole and zero plot for a selected form of electrical wave filter.

This interaural delay Bessel filter is implemented in the stage 704 of FIG. 7 by cascading or connecting in tandem two second-order multiple feedback low-pass filters, the filters of operational amplifiers U1C and U1D and U3C and U3D respectively in FIG. 7. The system function H(s) of the normalized fourth order Bessel filter provided by these cascaded circuits is defined by the relationship:

$$H(s)=105/(s^4+10s^3+45s^2+105s+105)$$

and has the pole-zero diagram shown in FIG. 4 of the drawings. In the FIG. 7 serial operational amplifier implementation, the first half of the filter has a quality factor (Q) of 0.522 and the second half has a Q of 0.805. Both stages have unity gain and a nominal cutoff frequency of 4000 radians per second. These differing quality factors result from inherent interrelationship of H(s) and Q in the simple filter circuit employed.

Figure 5:
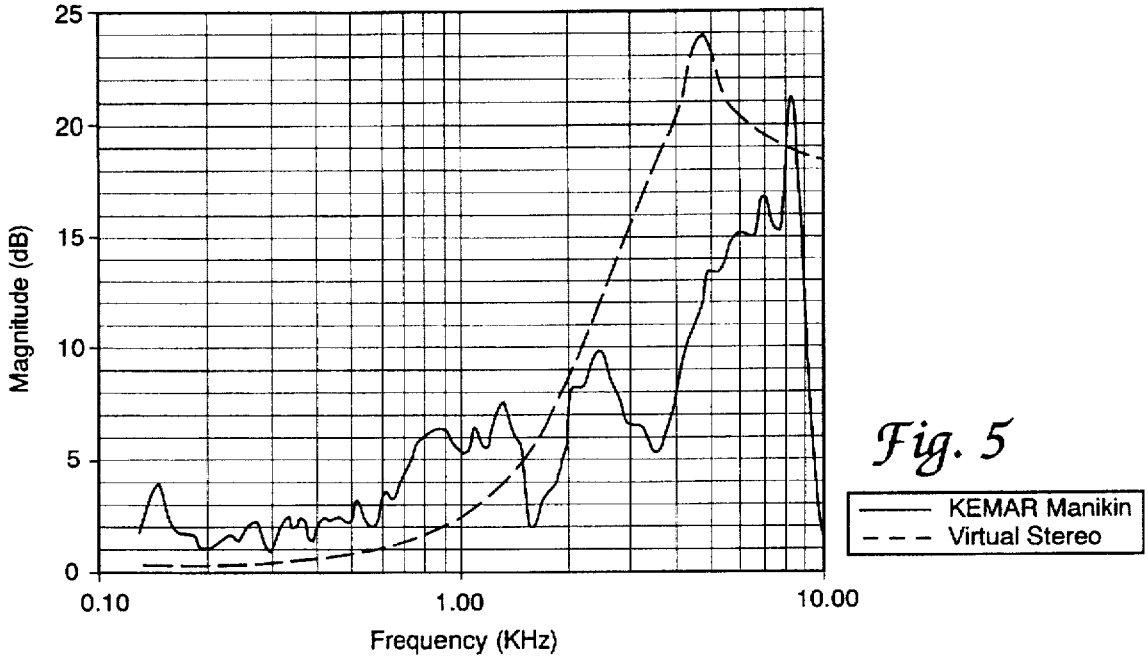
FIG. 5 shows an interaural transfer function comparison of mannequin and virtual signals.

Each of the interaural delay filters of the filter stage 704 in FIG. 7 receives the output signal of the pinna related filter of its channel and accomplishes its modification of this received signal before mixing with a signal from the other channel occurs. Therefore, the outputs of the filter stage 702 should be comparable to the interaural delay transfer function measured from the KEMAR mannequin. Such a comparison involves the ratio of the power spectrum of the near and far ears measured for a source at 30 degrees azimuth and 0 degrees elevation. FIG. 5 in the drawings shows this comparison.

Figure 6:
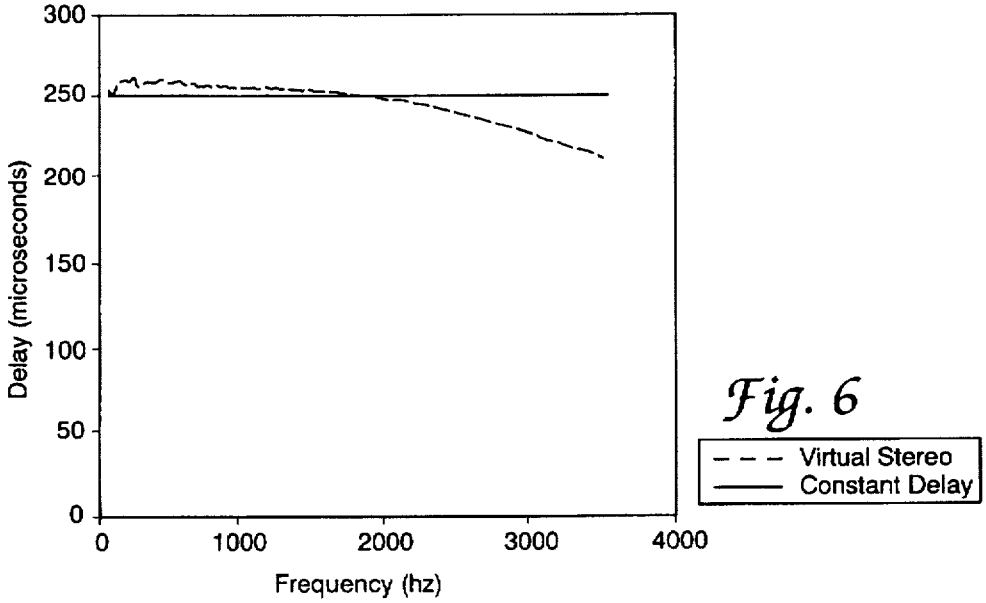
FIG. 6 shows a comparison of frequency vs. delay characteristics for time delayed and virtual stereophonic signals.

FIG. 5 shows that the interaural intensity difference (IID) above 2500 Hertz is somewhat larger for the present invention system than for the KEMAR measurements. While the achieved transfer function is therefore not optimal, it is within reason when the favorable phase characteristics of the achieved filter are considered. The group delay of the filter, as well as the constant group delay of 250 microseconds measured with the KEMAR mannequin, is shown in FIG. 6. The above cited Wightman and Kistler work found that the interaural time delay for frequencies below 2500 Hertz dominates all other lateralization cues. Therefore the phase response of the FIG. 7 filter, within ±3.5% of a constant group delay up to 2500 Hz, is considered favorable. The group delays above 3000 Hz for the FIG. 7 filters gradually fall off to zero, but the ITD in this range is generally believed to be irrelevant.

Output Summing Stage

The final stage 706 in the FIG. 7 schematic diagram is an operational amplifier summing circuit which mixes the output of the pinna related filters for each channel with the output of the interaural delay filter for the opposite channel. The drawing-illustrated summing circuit provides a gain of 3.8 dB for both inputs of each channel. This makes the overall gain of the entire FIG. 7 channels 708 and 710 approximately unity. The output signal from the operational amplifiers U2 and U4 of each FIG. 7 channel are shown connected to a stereophonic miniplug headphone jack.

The FIG. 7 active filters operate with approximately unity gain and a relatively low (20 KHz) required bandwidth. A variety of non-complex different operational amplifiers may therefore be used to implement the system. The disclosed implementation uses the type LM124 quadruple operational amplifiers for the signal processing stages and the type OP27 single operational amplifiers for the output stage. The OP27 amplifiers are used in the disclosed arrangement of the invention because of the higher output current involved in operating the headphones. These operational amplifiers require at least +2 volt and −2 volt dual power supplies. The disclosed circuit was implemented for energization with two 9-volt batteries connected in series, providing +9 volt and −9 volt power supplies. It is possible, however, to select low-power operational amplifiers and energize the FIG. 7 circuit from two AA size flashlight batteries. The voltage levels involved for mini-headphone listening are usually in the range of 200 millivolts, and never exceed one volt, so it is unlikely that any selected operational amplifier will be driven into nonlinearity or clip in this service.

The underlying concept of the present invention virtual stereophonic system therefore involves a cascading enhancement of input signal frequencies around 5 KHz in a pinna related filter, combining this enhanced signal and the original input signal to form one outer ear structure affected component of an output signal, and forming the other component of this output signal by delaying low frequency components of the opposite channel input signal. Both channels can be processed simultaneously by constructing a symmetrical circuit for each input channel and mixing together the outputs in this manner.

The described FIG. 7 circuit for accomplishing this processing employs only resistors, capacitors, and operational amplifiers to achieve a reasonably accurate approximation of the HRTF and ITD for virtual sound sources located at 30 degrees azimuth and 0 degrees elevation. No other currently available apparatus is known to achieve this result without using either expensive all-pass analog delay lines, requiring the use of switched capacitor circuitry or employing a complete digital signal processing system including a microprocessor, memory, and digital-to-analog and analog-to-digital converters.

The disclosed invention is supported by the results of recent research in the field of audio localization, including the findings that the ITD at frequencies below 2500 Hertz tends to dominate all other localization cues in a binaural audio signal, and by the realization that delays involving this limited frequency band can be implemented in better ways than have been used heretofore. The findings that the ITD at frequencies below 2500 Hertz tends to dominate all other localization cues in a binaural audio signal additionally allows use of a fourth order Bessel filter to implement the needed interaural time delay in the present embodiment of the invention. This filter has the potential drawbacks of a low-pass frequency response, and a decreasing group delay for high frequencies. Fortunately, however, the head shadowing effect occurring in loudspeaker stereophonic reproduction produces an inherently low-pass interaural transfer function, and also a dominance of low-frequency ITDs eliminate; the need for constant group delays above 2500 Hertz, therefore these two potential drawbacks, are not relevant. Without these fortuitous circumstances, however, a much more expensive all-pass, constant delay system would be required in implementing the externalized signals.

The approximation of the HRTF by adding the input signal to the input signal processed by a bandpass filter also provides present invention savings over a more complex stereophonic externalization system. Several other advantages occur in the present invention system because the input of the interaural delay filter is taken from the output of the pinna related filter rather than directly from the stereophonic input signals. First, the phase characteristics of the pinna related circuit are duplicated in both output channels, and can be ignored. If a separate filter were used for the left and right ears of the output signal, the filters for the far ear would have to produce all of the phase characteristics of the pinna related filter plus a fixed group delay. This would make the design of that filter far more complex. Furthermore, the disclosed cascading of the signals produces some of the achieved enhanced frequency response around 5 KHz, as is found to be needed in the KEMAR far ear HRTF. In a separate filter this bandpass characteristic would require an additional pole or zero.

The externalization system of the present invention has been disclosed in terms of providing a single selected location for the externalized sound sources. Clearly different locations for these sources are possible and may be achieved by repeating the above described realization process using different KEMAR mannequin related coordinates. It is also possible to achieve a different virtual location for the externalized sound sources (to at least a limited degree) by directly changing certain portions of the FIG. 7 circuit. For example, a different number of poles, i.e., a different order, for the FIG. 4 Bessel filter would have the effect of moving the apparent sound source in the direction of an azimuth position displaced from the nominal selected source locations of +30 degrees and −30 degrees.

Such moving of the apparent sound source from the nominal selected source locations of +30 degrees and −30 degrees by pole number change can be appreciated from the fact that increasing the number of poles increases the size of the circuit passband (assuming unity gain and constant group delay) relative to the nominal cutoff frequency. In the described preferred embodiment, a passband of 2.5 kilohertz is needed for group delay characteristics along with a cutoff frequency of about 1 kilohertz. More poles, however, allows a lower nominal cutoff frequency and therefore a greater time delay without audible distortion, and also increases the rolloff rate of the filter. Both of these characteristics are, however, consistent with azimuth locations greater than the nominal 30 degree location. Therefore, increasing the number of poles and decreasing the nominal frequency allows a simulation of source positions greater than 30 degrees.

Changes in the nominal cutoff frequency of the delay stage may, therefore, be used to achieve change of the stage 704 interaural time delay. Increased time delay may requires a higher order Bessel filter in order to maintain a constant group delay up to the 2500 Hertz frequency or conversely smaller time delays permit use of a lower ordered Bessel filter. The pinna related filter of stage 702 can also be "tweaked" to match the HRTF of a different location by changing the center frequency of the bandpass filter or by changing the attenuation of the non-filtered component of the stage 702 output signal.

While the addition of poles to the FIG. 4 drawing may be realized in the FIG. 7 schematic by adding additional reactive components and/or other operational amplifiers to the stage 704, attempts to achieve complete flexibility in the location of sound sources according to the concepts of the invention will require an ability to generate a variable interaural delay of between zero microseconds and one thousand microseconds in duration and also require reproducing a number of HRTF filters. These needs will complicate or make impossible the combined Bessel filter low pass and delay characteristics used in the present embodiment and indeed probably suggest the use of more conventional externalization arrangements. However, for achieving fixed position externalization that provides cost savings over the currently available digital based systems, considerably reduces power consumption and size, the presently disclosed arrangement is believed to be unparalleled.

To summarize, the disclosed system produces a very reasonable 60 degree separation of two audio signals with simple, analog, compact circuitry. While it does not offer the flexibility of a more traditional virtual audio display, in applications where the adjustment of source locations and head coupling is not required the disclosed system can perform to a notable degree. The provided enhancement is achieved by processing the audio signals presented over headphones to reduce differences between headphone presentation of the signals and presentation with stereophonic speakers or live sound sources. The accomplished processing results in a stereophonic image that appears to be outside the head, or externalized, when compared to the stereophonic image produced by unprocessed sound.

While the apparatus and method herein described constitute a preferred embodiment of the invention, it is to be understood that the invention is not limited to this precise form of apparatus or method and that changes may be made therein without departing from the scope of the invention which is defined in the appended claims.

What is claimed is:

1. Externalized stereophonic audio virtual signal source apparatus comprising the combination of:

a first audio frequency signal-processing channel having a first analog ear frequency response-simulating pinna related filter element coupled to a first stereophonic signal input node of said apparatus and a first analog Bessel filter signal delay element coupled to an output node of said first ear frequency response simulating analog pinna related filter element; and a second audio frequency signal-processing channel having a second analog ear frequency response-simulating pinna related filter element coupled to a second stereophonic signal input node of said apparatus and a second analog Bessel filter signal delay element coupled to an output node of said second ear frequency response simulating analog pinna related filter element;

said first audio frequency signal-processing channel further including a first signal summing output signal generator element having one input connected also with an output node of said first analog ear frequency response simulating filter element, another input connected with an output node of said second analog Bessel filter delay element and having an output signal path connected to a first output node of said audio frequency signal-processing channel; and said second audio frequency signal-processing channel further including a second signal summing output signal generator element having one input connected also with an output node of said second analog ear frequency response simulating filter element, another input connected with an output node of said first analog Bessel filter delay element and having an output signal path connected to a second output node of said audio frequency signal-processing channel.

2. The externalized stereophonic audio virtual signal source apparatus of claim 1 wherein each of said analog pinna related ear frequency response simulating filter elements are comprised of operational amplifier members, and each of said analog Bessel filter signal delay elements include multiple S-plane poles and are also comprised of operational amplifier members.

3. The externalized stereophonic audio virtual signal source apparatus of claim 2 wherein said first and second signal summing output signal generator elements each comprise an additional operational amplifier member.

4. The externalized stereophonic audio virtual signal source apparatus of claim 3 wherein each of said first and second audio frequency signal processing channels include an additional operational amplifier element connected as a buffer element and located intermediate said pinna related filter element and said analog Bessel filter signal delay element.

5. The externalized stereophonic audio virtual signal source apparatus of claim 1 wherein each of said analog pinna related ear frequency response simulating filter elements and each of said analog Bessel filter signal delay elements include an operational amplifier member having a pair of reactive elements in an output node to input summing node-connected feedback path.

6. The externalized stereophonic audio virtual signal source apparatus of claim 1 wherein said analog Bessel filter signal delay elements are fourth order Bessel filters each having S-plane plots which include four poles and one zero.

7. The externalized stereophonic audio virtual signal source apparatus of claim 1 wherein said analog Bessel filter signal delay elements are characterized by a bandpass upper corner frequency below three kilohertz in frequency.

8. The externalized stereophonic audio virtual signal source apparatus of claim 1 wherein said analog ear frequency response-simulating pinna related filter elements comprise means for summing a stereophonic input node signal of said apparatus with a selected frequency band emphasized modification of said same stereophonic input node signal.

9. The externalized stereophonic audio virtual signal source apparatus of claim 8 wherein said selected frequency band emphasized modification of said same stereophonic input node signal comprises a five kilohertz frequency band emphasized signal.

10. The method for generating apparently listener-displaced source stereophonic headphone-conveyed audio signals comprising the steps of:

altering the frequency content of a first stereophonic input channel audio frequency signal to emphasize input signal frequency components characteristic of human external ear resonances;

mixing a selected quantum of said altered first stereophonic input channel audio frequency input signal with a selected quantum of said first stereophonic input channel audio frequency signal to form a first simulated human ear pinna modified signal;

delaying said first simulated human ear pinna modified signal by a selected and listener ear to displaced source distance-related time interval;

excluding all except a selected band of frequencies from the first delayed signal;

altering the frequency content of a second stereophonic input channel audio frequency signal to emphasize input signal frequency components characteristic of human external ear resonances;

mixing a selected quantum of said altered second stereophonic input channel audio frequency input signal with a selected quantum of said second stereophonic input channel audio frequency signal to form a second simulated human ear pinna modified signal;

delaying said second simulated human ear pinna modified signal by a selected and listener ear to displaced source distance-related time interval;

excluding all except a selected band of frequencies from the second signal;

combining said altered first stereophonic input channel audio frequency signal with said altered and delayed second stereophonic input channel audio frequency signal to form a first output channel signal; and combining said altered second stereophonic input channel audio frequency signal with said altered and delayed first stereophonic input channel audio frequency signal to form a second output channel signal.

11. The method for generating apparently listener-displaced source stereophonic headphone-conveyed audio signals of claim 10 wherein said steps of delaying said first and second simulated human ear modified signals includes delaying said signals by a similar time interval for each of said first and second output channel signals.

12. The method of generating virtual, fixed in position, listener-displaced stereophonic headphone audio signals comprising the steps of:

altering first and second stereophonic input channel audio frequency signals in component frequency spectrum to emphasize selected midband frequencies characteristic of human external ear effects;

mixing in analog form a first selected quantum of said altered first stereophonic input channel audio frequency input signal with a second selected quantum of said first stereophonic input channel audio frequency signal to form a simulated human ear physiology-modified first composite signal;

combining in analog form a first selected quantum of said altered second stereophonic input channel audio frequency input signal with a second selected quantum of said second stereophonic input channel audio frequency signal to form a simulated human ear physiology-modified second composite signal;

generating a first analog stereophonic channel output signal by mixing a third selected quantum of said first composite signal with a delayed and high frequency deemphasized fourth selected quantum of said simulated human ear physiology-modified second composite signal; and forming a second analog stereophonic channel output signal by mixing a third selected quantum of said second composite signal with a delayed and high frequency de-emphasized fourth selected quantum of said simulated human ear physiology-modified first composite signal.

13. The method of generating virtual, fixed in position, listener-displaced stereophonic headphone audio signals of claim 12 wherein:

said step of altering first and second stereophonic input channel audio frequency signals in component frequency spectrum comprises emphasizing component frequencies in the five kilohertz frequency range; and said steps of generating and forming analog stereophonic channel output signals include both delaying and de-emphasizing said composite signals in an analog multiple-poled Bessel filter of four S-plane poles, two hundred fifty microseconds signal delay, nominal cutoff frequency of 636 Hertz and flat group delay up to 2400 Hertz characteristics.

14. Virtual externalized sound source headphone stereophonic audio apparatus comprising the combination of:

a first operational amplifier element inclusive and dual reactive element inclusive five kilohertz bandpass selective analog pinna related filter element connected to a left stereophonic signal input node of said apparatus;

a first analog sum signal generating and operational amplifier element inclusive signal summing circuit having one input connected to said left stereophonic signal input node of said apparatus and a second input connected to an output node of said first operational amplifier element inclusive and dual reactive element inclusive bandpass selective analog pinna related filter element;

a first tandem operational amplifier element inclusive analog Bessel electrical filter delay and low frequency selection element connected to said first analog sum signal, said tandem operational amplifier element inclusive Bessel electrical filter having four poles and one zero in its S plane plot and including two reactive elements in each of said tandem operational amplifiers;

a first stereophonic output channel signal generating and operational amplifier element inclusive analog signal summing circuit having one input connected to an output of said first analog Bessel electrical filter delay and low frequency selection element;

a second operational amplifier element inclusive and dual reactive element inclusive five kilohertz bandpass selective analog pinna related filter element connected to a right stereophonic signal input node of said apparatus;

a second analog sum signal generating and operational amplifier element inclusive signal summing circuit having one input connected to said right stereophonic signal input node of said apparatus and a second input connected to an output node of said second operational amplifier element inclusive and dual reactive element inclusive bandpass selective analog pinna related filter element;

a second tandem operational amplifier element inclusive analog Bessel electrical filter delay and low-frequency selection element connected to said second analog sum signal, said tandem operational amplifier element inclusive Bessel electrical filter having four poles and one zero in its S-plane plot and including two reactive elements in each of said tandem operational amplifiers; and a second stereophonic output channel signal generating and operational amplifier element inclusive analog signal summing circuit having one input connected to an output of said second analog Bessel electrical filter delay and low-frequency selection element and a second input connected to said first analog sum signal;

said first stereophonic output channel signal generating and operational amplifier element inclusive analog signal summing circuit also having a second input connected to said second analog sum signal.

15. The virtual externalized sound source headphone stereophonic audio apparatus of claim 14 further including a stereophonic headphone jack output port having a first conductive path connecting with said left and right stereophonic signal input nodes of said apparatus and a second conductive path connecting with said first and second stereophonic output channel signal generating summing circuits.

16. The virtual externalized sound source headphone stereophonic audio apparatus of claim 15 further including electrical battery elements connected to energization ports of said operational amplifiers.

17. Dual ear-externalized stereophonic audio virtual signal source apparatus comprising the combination of:

analog circuit bandpass shaping means for altering spectral content of each of a left and right channel stereophonic audio signals into externalized, human ear responseconformed amplitude and frequency components;

analog Bessel filter electrical circuit means for simultaneously delaying each of said left and right channel stereophonic audio signals by a selected temporal delay interval and for attenuating higher frequency components above 2500 Hertz from each of said left and right channel stereophonic audio signals;

means for mixing a bandpass shaping means spectrally-altered and undelayed signal from said stereophonic left channel with a bandpass shaping means spectrally-altered and delayed signal from said stereophonic right channel to form a first stereophonic virtually external output signal of said apparatus; and means for mixing a bandpass shaping means spectrally-altered and undelayed signal from said stereophonic right channel with a bandpass shaping means spectrally-altered and delayed signal from said stereophonic left channel to form a second stereophonic virtually external output signal of said apparatus.

* * * * *